United States Patent [19]

Durden et al.

[11] 4,180,164

[45] Dec. 25, 1979

[54] PACKAGING ARRANGEMENT FOR U-SHAPED FLUORESCENT LAMPS

[75] Inventors: Andrew Durden, Trumbull; Malcolm E. Sorrell, Norwalk, both of Conn.

[73] Assignee: Voltarc Tubes, Inc., Fairfield, Conn.

[21] Appl. No.: 954,329

[22] Filed: Oct. 25, 1978

[51] Int. Cl.[2] ..... B65D 85/42; B65D 85/62; B65D 81/02

[52] U.S. Cl. ..... 206/419; 206/443; 206/593; 229/15; 229/42

[58] Field of Search ..... 206/419, 418, 443, 592, 206/593; 229/15, 42, 2.5

[56] References Cited

U.S. PATENT DOCUMENTS

| | | | |
|---|---|---|---|
| 1,313,948 | 8/1919 | Maegly | 229/42 |
| 1,917,886 | 7/1933 | Hogan | 229/15 |
| 2,693,298 | 11/1954 | Palmer | 229/15 |
| 3,421,679 | 1/1969 | Goldman | 229/15 |
| 3,608,706 | 9/1971 | Vigue | 229/2.5 |

*Primary Examiner*—William T. Dixson, Jr.
*Attorney, Agent, or Firm*—Joseph Levinson

[57] ABSTRACT

A packaging arrangement for housing a plurality of U-shaped fluorescent lamps in a corrugated container is provided having a plurality of first and second corrugated inserts each having a plurality of aligned, spaced slots extending inward a predetermined distance from a first edge of each thereof. The inserts are mounted on one another by sliding one insert in the slots of the other, the slots being aligned and the inserts being positioned orthogonally with respect to each other and as assembled extending between the four sides of the container. The firt and second inserts when so mounted form a plurality of rectangular compartments therein which conform generally with and are adapted to house U-shaped fluorescent bulbs therein. The first insert includes a plurality of tabs spaced between its slots having a plurality of score lines along a lower extremity thereof which are shaped such that when bent along the score lines are adapted to receive and retain the legs of the U-shaped fluorescent lamp in the rectangular compartments. The outer extremities of the inserts overlap on opposite sides of the container and the assembled inserts. Crease pads are provided at the top and bottom of the container separating the assembled inserts therefrom which are adapted to space the lamps mounted in the container from the top and bottom and to absorb shock initiating from the top and bottom of the container. For shorter lamps, a double layer of inserts separated by a crease pad may be provided in the packaging arrangement for doubling the number of lamps which may be housed therein.

8 Claims, 7 Drawing Figures

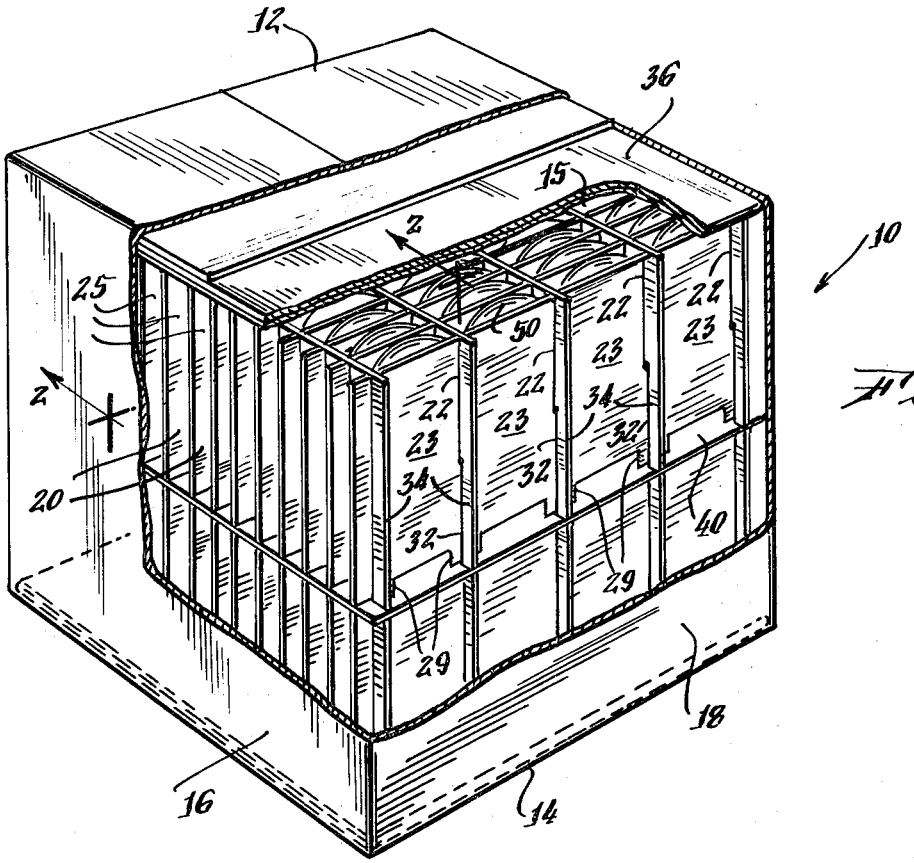
Fig. 1.
Fig. 2.
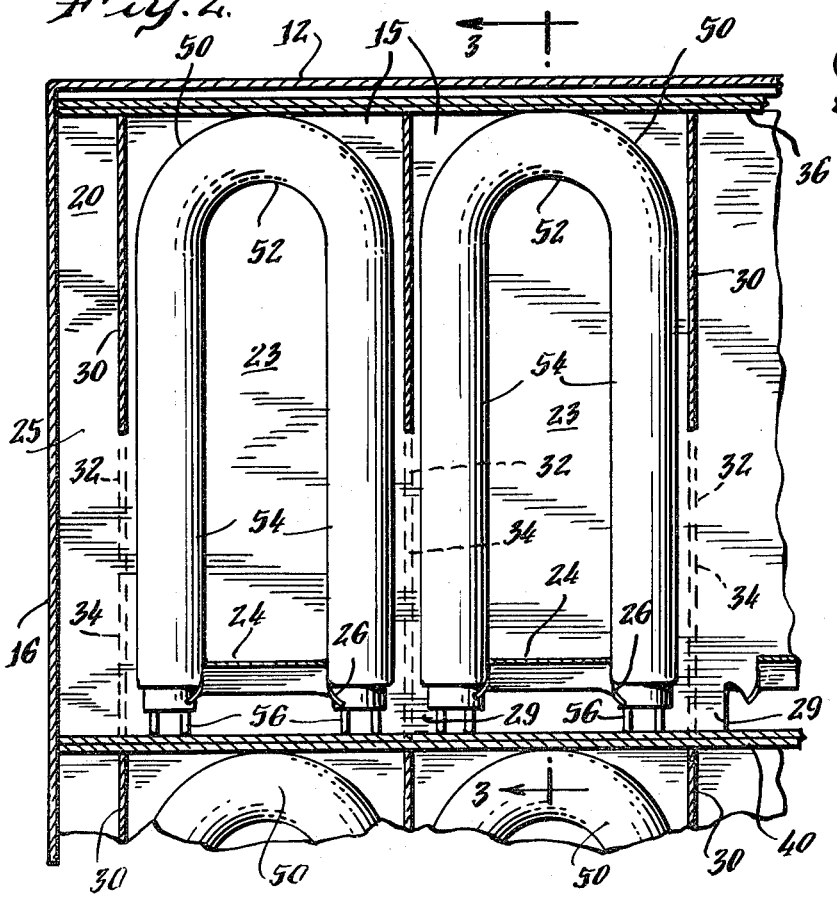
Fig. 3.
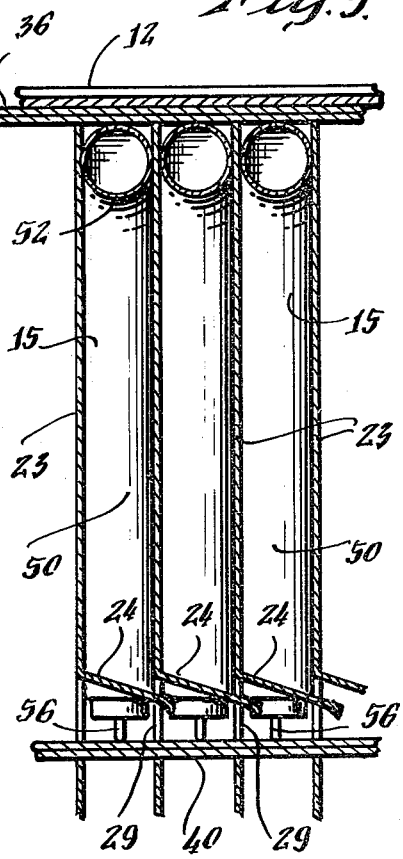

PACKAGING ARRANGEMENT FOR U-SHAPED FLUORESCENT LAMPS

BACKGROUND OF THE INVENTION

This invention relates to a packaging arrangement for housing fragile articles for the transport thereof and more particularly to a packaging arrangement for housing U-shaped fluorescent lamps therein.

The packaging of fragile articles provides a difficult problem when it is desired to transport such articles in the usual stream of commerce, even though such packages containing the fragile articles are marked with warnings that the contents must be handled with care. The packages are subject to mishandling causing an undue amount of breakage. This is particularly true with respect to such odd shaped fragile articles as U-shaped fluorescent lamps. Among the requirements for packaging such articles are to keep any outside blow from actually hitting or coming into contact with the article thereby breaking it. Also, any outside forces applied to the packaging must be reduced by the time they reach the product in order to protect the product from breakage, and further it is desirable to retain the product in its container in such a fashion that it does not move therein. This is particularly so with an article such as a U-shaped fluorescent lamp in which the U or the bent portion of the lamp is particularly vulnerable and any undue movement or shock thereof is liable to cause the breakage of the lamp. One ready solution to the problem is to heavily wrap the lamps with absorbent material such as foam or layers of corrugated cardboard in order to space the U-shaped lamp from the sides of the containers and to provide enough insulation to absorb any shock from reaching the product. However, these methods are expensive, time consuming and accordingly uneconomical.

Accordingly, it is an object of this invention to provide a new and improved packaging arrangement for housing a plurality of U-shaped fluorescent lamps for limiting the amount of breakage connected with the shipment thereof.

A further object of this invention is to provide a new and improved packaging means for U-shaped fluorescent lamps which is economical.

Still a further object of this invention is to provide a new and improved packaging means for a plurality of U-shaped fluorescent lamps which is suitable for use in the mass transport or shipment of the lamps.

SUMMARY OF THE INVENTION

In attaining these and other objects and advantages and carrying out this invention in one illustrative embodiment thereof, a packaging means for housing a plurality of U-shaped fluorescent lamps in a container is provided with a plurality of first and second overlapping and orthogonally mounted inserts. The inserts transverse the container and form therebetween a plurality of aligned rectangularly shaped compartments conforming generally to the exterior dimensions of the U-shaped lamps to be housed therein with the inserts extending a predetermined distance beyond the rectangular compartments for providing spacing between the compartments and the sides of the containers. The first inserts include a plurality of shaped tabs which are spaced along the inserts to provide a tab for each rectangularly shaped compartment. The tabs are shaped to accommodate and engage when folded the legs of the U-shaped fluorescent lamp which protrudes therefrom. For shorter lamps, a double layer of separate inserts are provided for doubling the capacity of the container.

BRIEF DESCRIPTION OF THE DRAWINGS

FIG. 1 is a isometric view with parts broken away of a packaging means for housing U-shaped lamps in accordance with one embodiment of the present invention, FIG. 2 is a partial cross-sectional view taken along line 2—2 of FIG. 1, FIG. 3 is a cross-sectional view taken along line 3—3 of FIG. 2.

DESCRIPTION OF THE PREFERRED EMBODIMENTS

Figure 4:
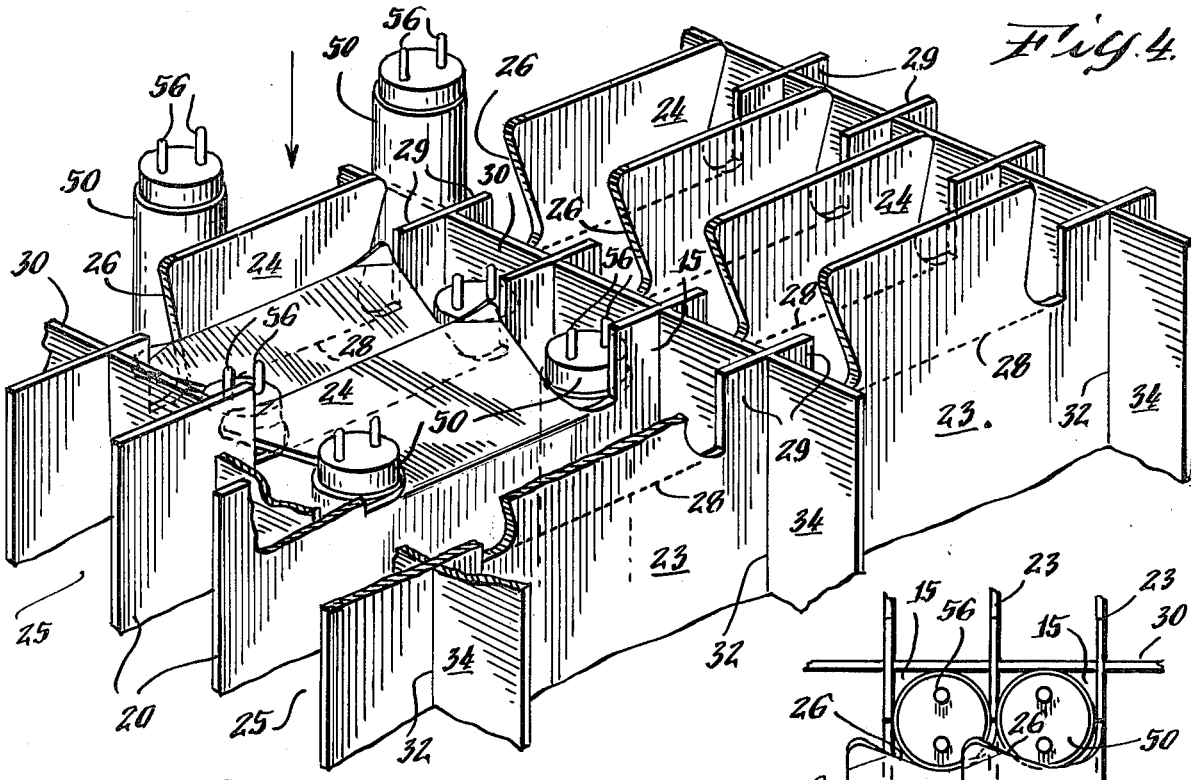
FIG. 4 is a partial isometric view illustrating the loading of U-shaped lamps in the packaging arrangement in accordance with the present invention.

Referring now to FIG. 1 which illustrates a packaging arrangement for housing a plurality of U-shaped lamps 50 in a box or container generally referred to with reference character 10. The container 10 is preferably a corrugated cardboard, but any other suitable material may be utilized. A plurality of partitions or dividers which are generally referred to herein as inserts 20 and 30 are mounted orthogonally with respect to each other as will be explained hereinafter and transverse the interior dimensions of the container 10. The container 10 has a top 12, a bottom 14 and a pair of sides 16 and 18. The inserts 30 extend between the opposite sides 18 while the inserts 20 transverse the container 10 between the opposite sides 16 thereby occupying the space between the sides 16 and 18. The inserts 20 and 30 form therebetween a plurality of rectangular compartments 15 which conform generally to the outside dimensions of the U-shaped fluorescent lamp 50 which the compartments 15 are adapted to contain or house.

FIG. 1 also discloses a second layer 60 of inserts duplicating compartments 15 therein as shown in the upper layer which are separated by a divider 40 which doubles the capacity of the container 10. The use of a double layer of compartments will depend upon the type of lamp which is to be used. For example, if shorter U-shaped lamps are to be packaged, i.e. on the order of 8 inches in length, then the double layer arrangement can be employed. However, if the lamps are longer, say on the order of 16 inches, then the container 10 may become too bulky and only a single layer would be utilized.

The first set of inserts 20 have a plurality of spaced slots 22 therein extending from one edge thereof to approximately mid-way down the insert 20 providing tongues 23 between the slots 22 and fingers 25 on the extremities thereof which space the inserts 20 from the sides 16 of the container 10. The other end of the insert 20 which is best illustrated in FIG. 4 includes a plurality of spaced tabs 24 having an inwardly extending concave configuration 26 which configuration is adapted to accommodate the legs 54 of a U-shaped lamp 50. The tab 24 is positioned between feet 29 and is scored along score line 28 to accommodate the folding or the bending of the tab 24 for engaging and captivating the legs 54 of a U-shaped lamp 50 inserted therein. As will be seen in FIG. 3 and FIG. 5, the tabs 24 are longer than the width of compartments 15 so that they overlap when bent inward which aids in holding the tabs 24 in position once they are bent inward.

The inserts 30 as seen in FIG. 1 have a plurality of slots 32 extending vertically from approximately midway thereon to the lower edge thereof forming fingers 34 therebetween as well as a finger 34 on the outer extremities thereof which finger along with the upper body portion of the insert 30 space the lamps 50 which are housed in the compartments 15 from the opposed sides 18 of the container 10.

The inserts 20 and 30 are assembled with the slots 22 of the insert 20 aligned with the slots 32 of the inserts 30. The inserts 20 and 30 are thus orthogonally mounted with respect to each other to form the rectangular shape compartments 15 therebetween as well as providing spacings from the sides 16 and 18 by the elements 25 and 34, respectively. By providing this opposed slot assembly configuration, the assemblage thereof is facilitated as well as accommodating a flat collapsible configuration for the assemblage which facilitates the shipment of the packaging before the lamps are inserted therein. The particular configuration of the inserts 20 and 30 and their assemblage also facilitate the packaging and removable of the U-shaped lamps 50 therefrom which will be discussed hereinafter.

FIG. 2 illustrates a front view of the lamp 50 having a bent portion 52 and legs 54 housed in the compartment 15 formed by the inserts 20 and 30. The legs 54 of the U-shaped lamp 50 are captivated and held in the compartment 15 by the folded tab 24 with the bases and pins 56 extending therethrough. As is illustrated in FIGS. 1 and 2, during shipment it is preferable to have the pins facing down so that they may absorb any of the vibration or shock to which the container 10 is subjected against the divider 40 or a crease pad 38 which contains a double layer of corrugated box board and performs a dual function of spacing as well as absorbing any external blows or shocks to which the container may be subjected. Although a divider 40 is illustrated in FIG. 1 as a single layer for ease of illustration, it may also be formed of a dual layer crease pad (as shown in FIGS. 2 and 3) when two layers of inserts are employed. As will be seen in FIG. 1 the top of the container 10 also includes a crease pad 36 which performs the same function as the crease pad 38 or the divider 40. Although a corrugated paper board is preferred because it is relatively inexpensive, other forms of spacers and dividers may be utilized; for example, plastic or foam.

FIG. 3 shows a side view of FIG. 2 with the lamps 50 held in place by the tabs 24 in the compartments 15 formed on the sides by the upper portions 23 which are integral part of inserts 20.

FIG. 4 illustrates the loading of the container 10 in which the lamps 50 are inserted bent down into the compartments 15. The tab 24 is then folded or bend along the score line 28 with the concave sides 26 of the tab 24 when folded engaging the legs 54 of the U-shaped lamp 50.

Figure 5:
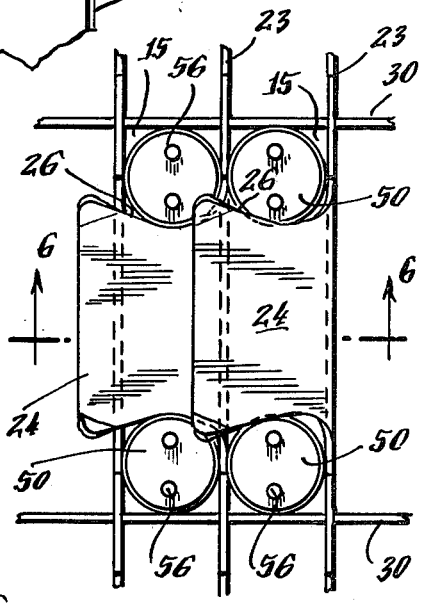
FIG. 5 is a partial top elevational view of FIG. 4 illustrating the captivation of a U-shaped lamp in the package arrangement in accordance with the present invention.

FIG. 5 illustrates the bottom view of a lamp inserted in the compartment 15 with the tab 24 folded over and with its concave sides 26 contacting the legs 54 thereby engaging and captivating the lamp 50 in the compartment 15 with the pins and bases 56 protruding therefrom.

Figure 6:
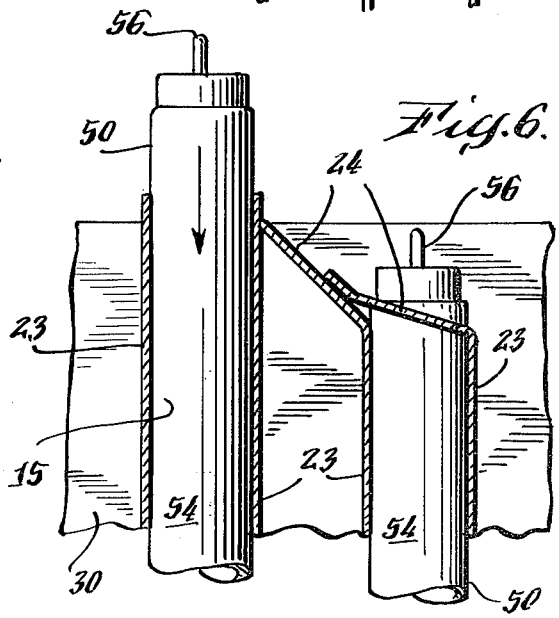
FIG. 6 is a partial cross-sectional view taken along line 6—6 of FIG. 5 illustrating the loading and securing of U-shaped lamps in the packaging arrangement in accordance with the present invention.

FIG. 6 illustrates one lamp which has been loaded with the tab 24 folded thereby securing the lamp in the compartment 15 and shows the insertion of another lamp before the tab 24 has been bent inward.

Figure 7:
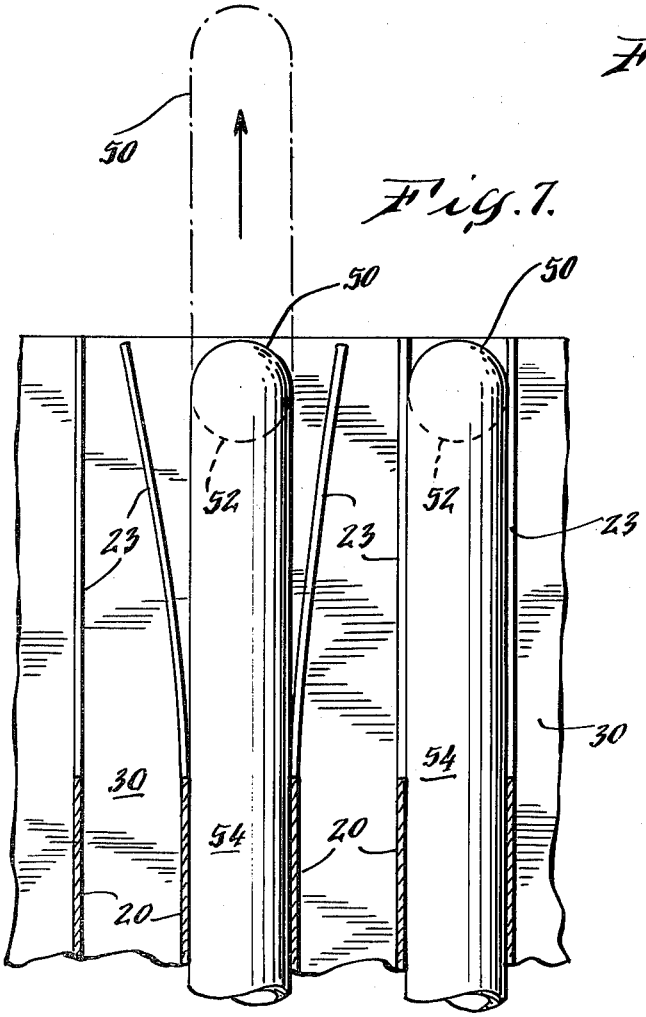
FIG. 7 is a partial cross-sectional view of the packaging arrangement in accordance with the present invention illustrating the unloading of the container housing the U-shaped lamps.

FIG. 7 illustrates how the present packaging arrangement for U-shaped lamps facilitates unloading the container 10. Unloading is accomplished by inverting the configuration as shown in FIG. 4 with the bend 52 of the lamp 50 facing upward. The slotted configuration of the insert 20 produces movable partitions or tongues 23 which can be bent outward to accommodate grasping the bend 52 of the U-shaped lamp for its ready removal from the compartment 15.

In the example chosen for purposes of illustration the container utilizes in each layer thirteen inserts 20 and five cooperating inserts 30 to form therebetween when assembled forty-eight compartments thereby accommodating four dozen U-shaped lamps. By utilizing a second layer 60 as illustrated in FIG. 1, ninety-six lamps can be accommodated in a single package. As has been pointed out, the number of layers which can be utilized will depend upon the application as well as the size of the lamps which are to be packaged. It will be appreciated that different sizes and numbers of compartments may be accommodated in accordance with the present invention.

The simple packaging arrangement which has been illustrated provides spacing and shock absorbing means for preventing an external blow from striking the product and causing outside forces to be reduced by the time they reach the product packaged therein. The U-shaped lamps are also captivated and held so that movement is limited within the compartments which also prevents damage to the very fragile and breakable article which is housed therein. The structure so provided is simple, inexpensive, facilitates the packaging and unloading of the U-shaped lamps which are housed therein and prevents breakage of the lamps in transit.

Since other modifications and changes varied to fit particular operating requirements and environments will be apparent to those skilled in the art, this invention is not considered limited to the examples chosen for purposes of illustration and covers all changes in modifications which do not constitute a departure from the true spirit and scope of this invention.

We claim:

1. A packaging arrangement for housing a plurality of U-shaped fluorescent lamps having an outer corrugated container comprising in combination, (a) a plurality of first corrugated inserts extending across a first dimension of said container having a plurality of aligned, spaced slots extending inward a predetermined distance from a first edge thereof and forming tongues therebetween, (b) a plurality of tabs having inwardly extending opposed concave sides shaped to receive the legs of U-shaped fluorescent lamps spaced between said slots of said first insert and extending from the second edge thereof opposite said first edge, said tabs having score lines along a lower extremity thereof above said opposed concave sides adapted when bent along said score lines to extend between and receive in the opposed concave sides thereof the legs of a U-shaped fluorescent lamp, (c) a plurality of second corrugated inserts extending across a second dimension of said container having a plurality of aligned, spaced slots which are complementary to the aligned, spaced slots of said first insert, and (d) said first and second inserts being mounted on each other in said container with said slots being in alignment and said inserts between positioned orthogonally with respect to each other forming a plurality of rectangular compartments therein adapted to house U-shaped fluorescent bulbs therein which are received in each compartment by bending said shaped tabs of said first insert along said score lines which captivates the legs of the U-shaped lamp in the compartments and thereby limits movement therein.

2. The packaging arrangement set forth in claim 1 wherein said first and second inserts when assembled overlap on opposite sides of said container to provide spacing between the sides of said container and said rectangular compartments therein.

3. The packaging arrangement set forth in claim 1 or claim 2 having spacer means positioned on the top and bottom thereof said container for spacing said inserts from said container and absorbing shock received from an external blow on the container.

4. The packaging arrangement set forth in claim 1 or claim 2 having a double layer of assembled inserts in said container separated by a shock absorbing spacer means.

5. A packaging means for housing a plurality of U-shaped fluorescent lamps in a container comprising:

(a) a plurality of first and second inserts overlapping and orthogonally mounted with respect to each other in said container, (b) said inserts traversing said container and forming therebetween a plurality of aligned, rectangularly-shaped compartments adapted to receive U-shaped fluorescent lamps therein, (c) said inserts extending a predetermined distance beyond said rectangular compartments for providing spacing between the rectangular compartments and the sides of said container, and (d) a plurality of shaped tabs having inwardly extending opposed concave sides which are spaced along said first inserts to provide a tab for each rectangular-shaped compartment, said inwardly extending opposed concave sides on said tabs being shaped to accommodate and engage the legs of U-shaped fluorescent lamps when folded therebetween which legs protrude therethrough, said tabs enclosing said compartments.

6. The packaging means set forth in claim 5 in which said tabs generally have a trapezoidal shape and are integral with the insert and scored along the connection thereof to facilitate folding and engaging the legs of a U-shaped lamp.

7. The packaging means set forth in claim 5 having crease pads positioned above and below said inserts in said container for providing cushioning for the lamps positioned therein.

8. The packaging means set forth in claim 6 or claim 7 having a double layer of said first and second inserts positioned in said container and separated by a crease pad.

* * * * *

UNITED STATES PATENT OFFICE

CERTIFICATE OF CORRECTION

Patent No. 4,180,164 Dated December 25, 1979

Inventor(s) Andrew Durden and Malcolm E. Sorrell

It is certified that error appears in the above-identified patent and that said Letters Patent are hereby corrected as shown below:

Column 2 of the Abstract, line 8, change "firt" to -- first --.

Claim 6, line 4, cancel "thereof" and insert -- above said trapezoidal shape --.

Signed and Sealed this

*Twenty-second* Day of *April 1980*

[SEAL]

*Attest:*

SIDNEY A. DIAMOND

*Attesting Officer*

*Commissioner of Patents and Trademarks*